United States Patent [19]

McDermott

[11] 4,021,161

[45] May 3, 1977

[54] ROTARY FLUID PRESSURE DEVICE AND THRUST ABSORBING ARRANGEMENT THEREFOR

[75] Inventor: Hugh L. McDermott, Minneapolis, Minn.

[73] Assignee: Eaton Corporation, Cleveland, Ohio

[22] Filed: Feb. 17, 1976

[21] Appl. No.: 658,330

[52] U.S. Cl. ..... 418/61 B; 64/9 R; 403/121

[51] Int. Cl.[2] ..... F01C 1/02; F16D 3/18; F16C 32/00; F01C 21/00

[58] Field of Search ..... 418/61 B; 64/9 R; 60/384; 403/121

[56] References Cited

UNITED STATES PATENTS

| | | | |
|---|---|---|---|
| 3,657,903 | 4/1972 | Woodling | 418/61 B |
| 3,782,866 | 1/1974 | McDermott | 418/61 B |

*Primary Examiner*—John J. Vrablik
*Attorney, Agent, or Firm*—Teagno & Toddy

[57] ABSTRACT

A rotary fluid pressure device of the type including a gerotor gear set having an externally-toothed rotor orbiting and rotating within an internally-toothed stator. An intermediate shaft has one end in splined engagement with the rotor and the other end defining a large set of internal splines. The device includes an output shaft assembly, also defining a large set of internal splines, with a large dogbone shaft transmitting torque between the intermediate shaft and the output shaft assembly. A portion of the housing disposed between the gerotor gear set and the end of the intermediate shaft defining the internal splines is engaged by the enlarged portion of the intermediate shaft, resulting in large and random axial forces being exerted by the intermediate shaft. To absorb such thrust forces, a wear ring is seated within a recess formed in the housing portion and includes an annular wear surface defining an axis substantially coincidental with the axis of the internally-toothed stator. During operation, with the intermediate shaft orbiting and rotating, the wear surface is engaged by a stop surface on the intermediate shaft. With the wear surface having an average diameter equal to N (the number of internal teeth on the stator) multiplied by 2E (where E is the eccentricity of the gerotor), rubbing action and the resulting wear occurring conventionally between the stop surface and the wear surface is eliminated and the engagement occurring therebetween is substantially pure rolling motion.

7 Claims, 3 Drawing Figures

ROTARY FLUID PRESSURE DEVICE AND THRUST ABSORBING ARRANGEMENT THEREFOR

BACKGROUND OF THE DISCLOSURE

The present invention relates to rotary fluid pressure devices, and more particularly, to an improved thrust absorbing arrangement for use therein.

The invention is especially suited for use with hydraulic gerotor motors, a typical example of which is shown in U.S. Pat. No. 3,572,983, assigned to the assignee of the present invention. It has long been recognized that in such devices, there must be included some means for limiting the axial movement of the main drive shaft. Examples of such means are illustrated in U.S. Pat. No. 3,899,270, also assigned to the assignee of the present invention. In motors of the type shown in the first-referenced patent, because of the relatively low torques being transmitted by the main drive shaft, it was possible, by arrangements known in the art, to limit the axial movement of the main drive shaft in a manner which was generally satisfactory. However, it will be appreciated that as the torque output capability of such motors increased, the axial forces acting on the main drive shaft also increased, thus complicating the problem of satisfactory axial retention of the drive shaft.

More recently, the torque output capability of gerotor motors has been greatly increased by the development illustrated in U.S. Pat. No. 3,782,866, assigned to the assignee of the present invention. The basis for this development was the realization that the primary factor limiting the torque output capability of the motor was the strength of the spline connection between the rotor and the main shaft and between the main shaft and the output shaft. Thus, it is now well-known in the art to provide a high torque gerotor motor utilizing an intermediate shaft, one end of which is connected to the rotor of the gerotor by a set of straight splines, and the other end of which defines the relatively large set of internal splines. At the same time, the output shaft also defines a relatively large set of internal splines and a large dogbone shaft having external splines at either end thereof provides the main drive connection between the intermediate shaft and the output shaft.

With the increased size and strength of such spline connections, the torque output capability of this type of motor is now frequently in a range of 40,000–60,000 inch pounds. Because of unbalanced frictional forces in the various spline connections, output torques of the magnitude mentioned can frequently result in an axial force on the intermediate shaft in the range of about 10,000 pounds. This magnitude of axial resultant force may bias the intermediate shaft toward a rotating disc valve member for one rotational direction of operation, and in the opposite axial direction for the opposite rotational direction of operation, such that no force is acting on the disc valve.

An attempt has been made in the prior art to limit the axial movement of the intermediate shaft or main drive shaft, toward the disc valve member, by means of increasing the hydraulic force behind this valve member to maintain it in sealing contact with the adjacent port plate or housing portion. It will be appreciated, however, that this is not a satisfactory solution in the very high torque gerotor motors described above wherein it would be necessary to utilize such a high continuous biasing force which, when the axial force on the intermediate shaft was lower, or eliminated completely because of reversed operation, would still be applied to the disc valve member, producing an excessive load, friction and wear on the mating valve surfaces.

A different approach to limiting the axial movement of the main drive shaft is illustrated in U.S. Pat. No. 3,657,903, wherein the main drive shaft is provided with a shoulder having a rubbing surface which engages a mating rubbing surface on the adjacent, stationary valve member. In such an arrangement, a frictional force is developed as a result of the rubbing action between the mating wear surfaces, with the magnitude of such frictional forces being generally proportional to the torque output capacity of the device. Therefore, although the axial limiting arrangement of the above-referenced patent may be generally satisfactory for the relatively lower torque motors of the type shown in U.S. Pat. No. 3,572,983, such an arrangement is no longer satisfactory for use with relatively higher torque motors now available, and as taught in the '903 patent, the arrangement is not even applicable to the most recently developed motors such as those shown in U.S. Pat. No. 3,782,866.

SUMMARY OF THE INVENTION

Accordingly, it is an object of the present invention to provide a rotary fluid pressure device having an improved arrangement for limiting axial movement of the main drive shaft, or in a device of the type illustrated in the '866 patent, the intermediate shaft.

It is another object of the present invention to provide such an improved arrangement for limiting axial shaft movement in which an annular stop surface associated with the shaft member engages a mating, stationary wear surface.

It is a more specific object of the present invention to provide such an arrangement in which the engagement between the stop surface and the wear surface is primarily rolling engagement and rubbing action therebetween is substantially eliminated.

It is a related object of the present invention to provide such an arrangement in which the diameter of the wear surface is selected in such a manner that the force reaction between the mating stop surface and wear surface is substantially free of the relative motions of rotation and orbiting.

The above and other objects of the present invention are accomplished by the provision of a rotary fluid pressure device comprising a first member having a plurality N of internal teeth and a second member having a plurality N-1 of external teeth, with the second member being disposed within the first member at an eccentricity E for orbital and rotational movement therein. An output shaft assembly is mounted for rotation relative to the first member and a shaft member has one portion in engagement with the second member and another portion in engagement with the output shaft assembly to transmit torque between the second member and the output shaft assembly. A portion of the housing adjacent the shaft member defines a generally annular wear surface disposed about the shaft member and the shaft member includes a stop surface extending outwardly from the shaft member for engagement with the wear surface when the shaft member is biased toward the second member. The wear surface is disposed between the stop surface on the shaft member and the second member and has an average diameter approximately equal to D, wherein $D = N \times 2E$.

DESCRIPTION OF THE PREFERRED EMBODIMENT

Figure 1:
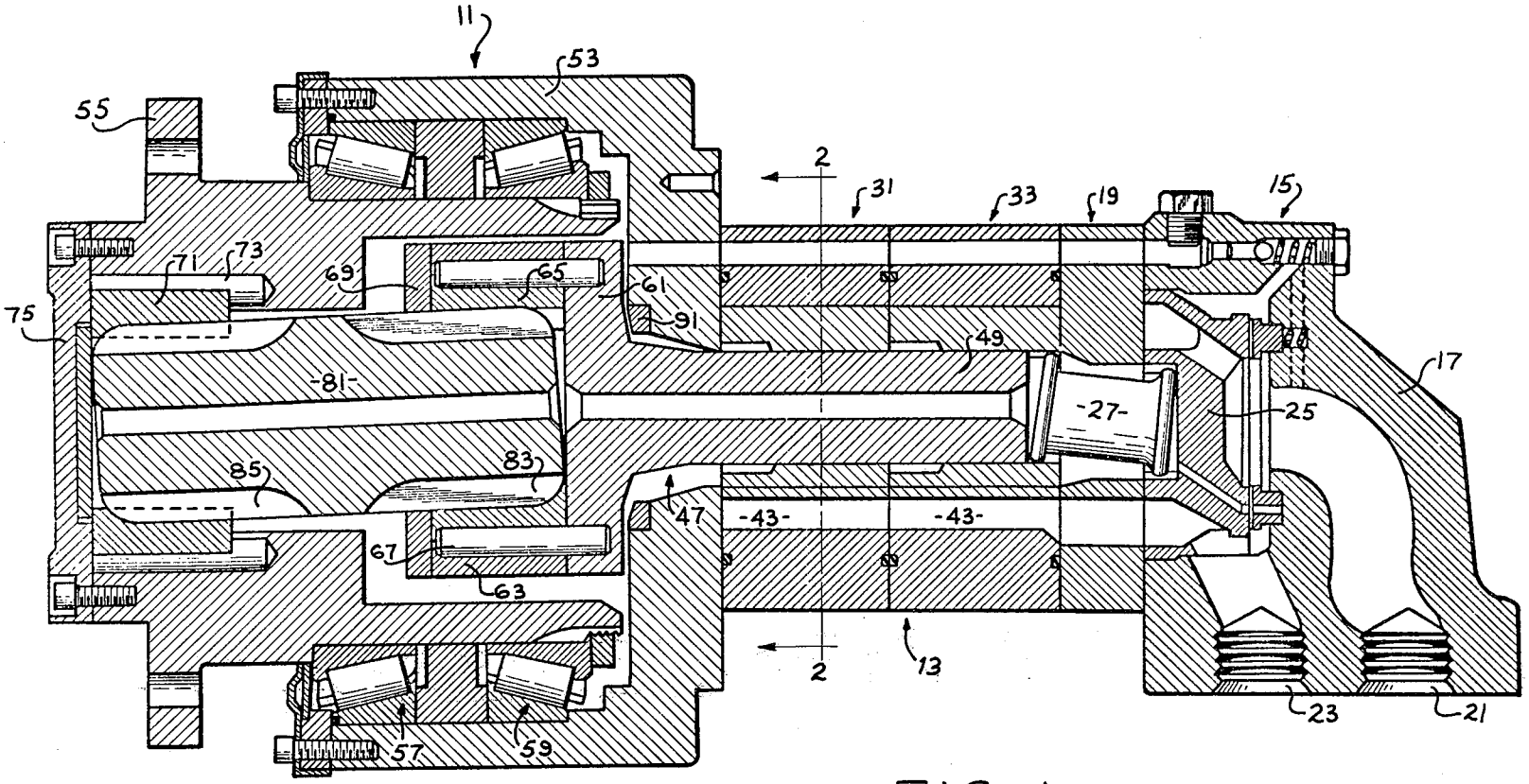
FIG. 1 is an axial cross section of a gerotor motor made in accordance with the teachings of the present invention.

Referring now to the drawings, which are not intended to limit the present invention, FIG. 1 illustrates a hydraulic motor including an output section, generally designated 11, a gerotor section, generally designated 13, and a valve section, generally designated 15. The valve section 15 may be of the type well-known in the art, such as is illustrated in U.S. Pat. No. 3,572,983, which is incorporated herein by reference. The referenced patent also describes and illustrates the operative association of the valve section 15 with the gerotor section 13. The configuration of the output section 11, as well as its operative association with the gerotor section 13, is described and illustrated in U.S. Pat. No. 3,782,866, which is also incorporated herein by reference. Thus, the details and operation of sections 11, 13, and 15, will be described only briefly.

The valve section 15 includes a body portion 17 and a port plate 19. The body portion 17 defines an inlet port 21 and an outlet port 23 (see flow arrows), and a disc valve member 25 is rotatably disposed within the body portion 17. A valve drive shaft 27 transmits rotational movement of the gerotor section 13 to the disc valve member 25, and a valve balancing ring 29 is seated within the body portion 17 and against the disc valve member 25.

Figure 2:
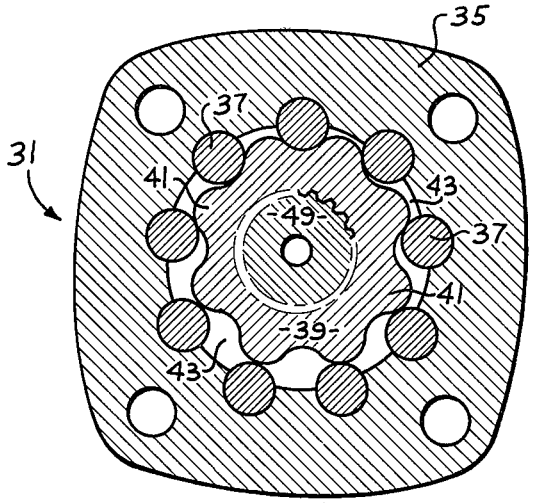
FIG. 2 is a transverse cross section taken on line 2—2 of FIG. 1.

In the subject embodiment, the hydraulic motor is a high torque output motor and thus, the gerotor section 13 comprises a pair of substantially identical gerotor gear sets 31 and 33, each of which, as may be seen in FIG. 2, includes a stator member 35 having a plurality of generally semi-cylindrical pockets receiving rollers 37, serving as the internal teeth of the stator 35. Each gerotor gear set also includes a rotor 39 having a plurality of external teeth 41, the number of teeth 41 being one less than the number of rollers 37, such that the external teeth 41 and rollers 37 interengage to define a plurality of expanding and contracting volume chambers 43 as is well-known in the art.

An intermediate shaft assembly 47 includes a shaft portion 49 in splined engagement with each of the rotors 39, such that the gerotor gear sets 31 and 33 will, at any instant, have all of their component parts in the same relative position.

The output section 11 includes a casing 53 within which an annular output member 55 is mounted for rotation, such as by means of a pair of tapered roller bearing sets 57 and 59. The intermediate shaft assembly 47 includes a flange portion 61 to which is attached by any suitable means a sleeve member 63. Disposed within the sleeve member 63 is an internally-splined member 65, with relative rotation between the sleeve member 63 and internally splined member 65 being prevented by means of a plurality of torque pins 67. Relative axial movement between the sleeve member 63, spline member 65, and torque pins 67 is prevented by a retainer plate 69, attached at the forward end of the intermediate shaft assembly 47. Disposed within the output member 55, and at the forward end thereof, is an internally splined member 71, which may be similar, or even identical to the internally splined member 65. The splined member 71 may be positioned non-rotatably relative to the output member 55 by means of a plurality of torque pins 73, with axial retention of the spline members 71 and pins 73 being achieved by means of a cover 75, bolted to the output member 55.

Disposed within the output member 55 is a dogbone shaft 81, having a set of external splines 83 in splined engagement with the internally-splined member 65 and a set of external splines 85 in splined engagement with the internally-splined member 71, to transmit the orbital and rotational movement of the intermediate shaft assembly 47 into pure rotational movement of the output member 55.

It should be appreciated that although the present invention is being described, in connection with a high torque motor, it may be utilized with various other types of fluid pressure devices, such as a pump, in which case the output section 11 would actually be the input. Therefore, it should be understood that, as used herein, such terms as "output shaft" are not intended to limit the present invention, and the use of such terms is intended to mean and include input shafts, as in the case of a pump, as well as elements such as output member 55 which are not actually in the form of a conventional shaft.

Figure 3:
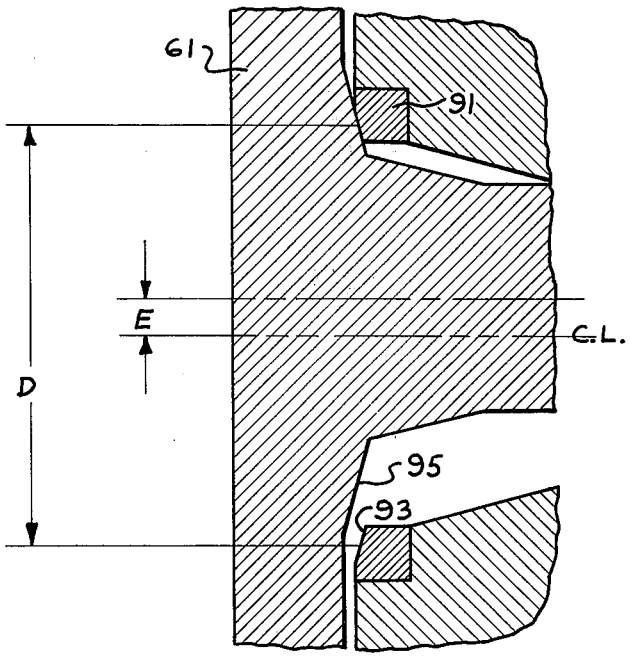
FIG. 3 is a fragmentary cross section, similar to FIG. 1, illustrating the dimensional relationships taught by the present invention.

As may be seen by viewing FIG. 3, in conjunction with FIG. 1, the casing 53 in the area adjacent the flange portion 61 defines an annular recess into which is seated a ring member 91, including an annular, frusto-conical wear surface 93. It will be noted that the wear surface 93 is oriented at an acute angle relative to the vertical plane, in the subject embodiment, the angle being approximately 15°. On the flange portion 61 there is a stop surface 95 which is disposed for engagement with the wear surface 93 and, preferably, is oriented at approximately the same angle relative to the vertical plane as is the wear surface 93.

As may be seen in FIG. 3, the wear surface 93 defines an average diameter D (or a radius D/2 measured from the center line CL of the casing 53). It is a feature of the present invention that the average diameter D of the wear surface 93 is selected such that, during operation of the device and the resulting orbiting and rotation of the intermediate shaft assembly 47, the stop surface 95 is in rolling engagement with the wear surface 91 and there is substantially no relative sliding or rubbing action between the surfaces 93 and 95.

In order to accomplish this, the wear surface 93 is sized such that the average diameter $D = N \times 2E$, wherein;

$N$ is the number of internal teeth 37, and $E$ is the eccentricity of the rotor 39 within the stator 35.

It will be appreciated that perfect rolling of the surfaces 93 and 95 occurs only on the circle where $D = N \times 2E$, whereas, a very slight amount of rubbing occurs on either side thereof (i.e., radially inward or radially outward therefrom). In order to minimize even such incidental rubbing, it is preferred that the diameter on wear surface 93 for which $D = N \times 2E$ should be the average diameter, although, if another diameter of wear surface 93 (such as the major diameter or minor diameter) is equal to $N \times 2E$, a fair approximation will be provided, i.e., the rubbing between surfaces 93 and 95 will be minimal. Because the slight amount of rubbing which occurs between surfaces 93 and 95 is greater at a further radial distance from the circle for which the diameter is equal to $N \times 2E$, it is desirable to select an optimum radial width for the wear surface 93 such that the rubbing action is minimal but the total area of wear surface 93 is sufficient to support the axial load exerted thereon by the shaft 47.

It should be understood that although the preferred embodiment utilizes a separate ring member 91, such is not an essential feature of the invention and it is contemplated that the wear surface 93 may be machined within the casing 53, or provided in some other manner. The separate ring member 91 is preferred because it may be heat treated and the wear surface 93 hardened more easily than if the wear surface is merely machined within the casing 53.

Although in the preferred embodiment the intermediate shaft assembly 47 does not wobble (i.e., its axis remains substantially parallel to the axis of the casing 53 and the stator members 35), it should be clearly understood that the invention may be utilized in a more conventional gerotor device, such as the motor of U.S. Pat. No. 3,572,983.

I claim:

1. A rotary fluid pressure device comprising:

a. a first member having a plurality N of internal teeth;

b. a second member having a plurality N—1 of external teeth, said second member being disposed within said first member for orbital and rotational movement therein, said internal teeth and said external teeth interengaging during said movement to define a plurality of expanding and contracting volume chambers;

c. an output shaft assembly mounted for rotation relative to said first member;

d. a shaft member having one portion in engagement with said second member and another portion in engagement with said output shaft assembly to transmit torque between said second member and said output shaft assembly;

e. housing means defining a generally annular frustoconical wear surface disposed about said shaft member and defining an axis substantially coincidental with the axis of said first member;

f. said shaft member including a stop surface extending outwardly from said shaft member for engagement with said wear surface when said shaft member is biased toward said second member, said wear surface being disposed between said stop surface and said second member, the movement of said shaft member adjacent said stop surface defining an eccentricity E about said axis of said wear surface;

g. said wear surface having an average diameter approximately equal to D, wherein:

$$D = N \times 2E.$$

2. A rotary fluid pressure device comprising:

a. a first member having a plurality N of internal teeth;

b. a second member having a plurality N—1 of external teeth, said second member being disposed within said first member at an eccentricity E for orbital and rotational movement therein, said internal teeth and said external teeth interengaging during said movement to define a plurality of expanding and contracting volume chambers;

c. an output shaft assembly mounted for rotation relative to said first member;

d. a shaft member having one portion in engagement with said second member and another portion in engagement with said output shaft assembly to transmit torque between said second member and said output shaft assembly;

e. housing means defining a generally annular frustoconical wear surface disposed about said shaft member and defining an axis substantially coincidental with the axis of said first member;

F. said shaft member including a stop surface extending outwardly from said shaft member for engagement with said wear surface when said shaft member is biased toward said second member, said wear surface being disposed between said stop surface and said second member;

g. said wear surface having an average diameter equal to D, wherein: $D = N \times 2E$.

3. A rotary fluid pressure device as claimed in claim 2 wherein said diameter D is approximately the average diameter of said wear surface.

4. A rotary fluid pressure device as claimed in claim 2 wherein said output shaft assembly comprises a rotatable output member defining internal splines and a dogbone shaft having one end in engagement with said internal splines and the other end in splined engagement with said shaft member.

5. A rotary fluid pressure device as claimed in claim 2 wherein said second member defines a set of straight internal splines and said shaft member includes a set of straight external splines in engagement with said internal splines.

6. A rotary fluid pressure device as claimed in claim 2 wherein said first member defines a stationary axis and said shaft member defines an axis which orbits about said stationary axis, said orbiting axis and said stationary axis remaining substantially parallel during said orbital and rotational movement of said first and second members.

7. A rotary fluid pressure device as claimed in claim 6 wherein said wear surface and said stop surface are oriented at approximately the same angle relative said stationary axis.

* * * * *